US005400844A

United States Patent [19]

Pollack

[11] Patent Number: 5,400,844

[45] Date of Patent: Mar. 28, 1995

[54] FASTENING DEVICE - TOOL HOLDER

[76] Inventor: R. Bruce Pollock, 38 W. Barber Ave., Woodbury, N.J. 08096

[21] Appl. No.: 16,415

[22] Filed: Feb. 11, 1993

[51] Int. Cl.[6] ..... B25H 1/00

[52] U.S. Cl. ..... 144/286 A; 29/469; 29/560; 144/286 R; 269/87; 269/196; 269/199; 269/236; 409/219

[58] Field of Search ..... 144/286 R, 286 A; 269/87, 101, 196, 199, 200, 217, 229, 236; 83/574; 409/163, 219, 224; 408/87; 29/464, 469, 525, 560

[56] References Cited

U.S. PATENT DOCUMENTS 4,669,173 6/1987 Chaney, Sr. ..... 144/286 R
4,688,974 8/1987 Wright et al. ..... 409/219
4,971,488 11/1990 Mihara et al. ..... 409/219
5,050,291 9/1991 Gilmore ..... 29/560

*Primary Examiner*—W. Donald Bray

[57] ABSTRACT

The tool holder is designed to hold an object rigidly in place, at a strategic location, with the benefits of simplicity of placement and easy removal. There are two basic parts: base assembly and the tool mount assembly that mates with it. A spring loaded, cam activated piston locks the pieces together. A non-locking internal conical taper permits 360 degree rotation. A handle mounted on the side activates the camming mechanism to lock the tool or object rigidly in place, being secured to the tool mounting surface.

5 Claims, 3 Drawing Sheets

FASTENING DEVICE - TOOL HOLDER

BACKGROUND OF THE INVENTION

This invention relates generally to fastening devices, and in particular to a tool holder which can be attached to a work bench and which can hold a variety of tools.

The ability to rigidly mount a tool on a tool bench and remove it without the conventional uses of screws, nuts and bolts, clamps, etc. increases the efficiency of work area and saves time.

The working surface of a work bench is, or can be, a very valuable surface area. Often the handyman, do-it-yourselfer or mechanic finds that the space available is marginally sufficient. This fastening device can help with this problem. The tools that usually occupy valuable work bench space can be secured to the tool mounted assembly of the tool holder. What is normally a permanently mounted object is easily removed when not needed.

Fastening devices or tool holders have taken many forms, all of which seem to focus on simplicity of placement and rigidity of the union. The design of such devices is largely determined by the specific function they are to perform. There appears to be a lack of tool holder designs that can adequately provide the strength, rigidity and simplicity needed while still providing a means for easily mounting a wide variety of bench tools.

OBJECTS OF THE INVENTION

Accordingly, it is the general object of the instant invention to provide a tool holder which overcomes the shortcomings of, and improves upon, existing tool holders.

It is a further object of the instant invention to provide a tool holder which can rigidly mount a variety of bench tools such as vises, drill presses, grinders, arbor presses and other useful tools.

It is yet a further object of the instant invention to provide a tool holder which is solid and is strong and can withstand hundreds of foot-pounds of force.

It is still yet a further object of the instant invention to provide a tool holder in which bench tools can be easily mounted.

It is another object of the instant invention to provide a tool holder in which a bench tool can be mounted which can be rotated to a desired position and then be rigidly clamped in position.

SUMMARY OF THE INVENTION

These and other objects of the instant invention are provided by a tool holder which is designed to hold an object rigidly in place, at a strategic location, with the benefits of simplicity of placement and easy removal. The tool holder has two basic parts: the base assembly and the mounting assembly that mates with it. A tool, i.e., vise, drill press, grinder, etc., is mounted to the tool mounting surface. The tool is mounted on the top surface of a camming mechanism which is one of the components of the mounting assembly. With the tool attached to the mounting assembly via the tool mounting surface, the tool is ready to be rigidly mounted to the work bench where the base assembly is permanently fastened. The placement of the tool is accomplished by simply inserting the tenon of the mounting assembly into the mortise of the base assembly. With the tool stationary, and the tenon of the mounting assembly fully seated with the mortise of the base assembly, a clockwise pull on the handle of the mounting assembly will rotate a piston, pins and the handle clockwise. The clockwise rotation of the handle, and subsequently the piston and pins, forces the piston slightly downward through the action of the pins and handle on the camming mechanism. The tool remains stationary and is locked in place through the downward force of the piston. A slight counterclockwise force on the handle will lessen the pressure from the camming mechanism and permit 360° swivelability of the tool, i.e., holding the tool, stationary at any angle and pulling clockwise on the handle will lock the tool rigidly in place.

DESCRIPTION OF THE DRAWINGS

Other objects and many of the intended advantages of this invention will be .readily appreciated when the same becomes better understood by reference to the following detailed description when considered in connection with the accompanying drawings wherein.

DETAILED DESCRIPTION OF THE PREFERRED EMBODIMENT

Figure 1:
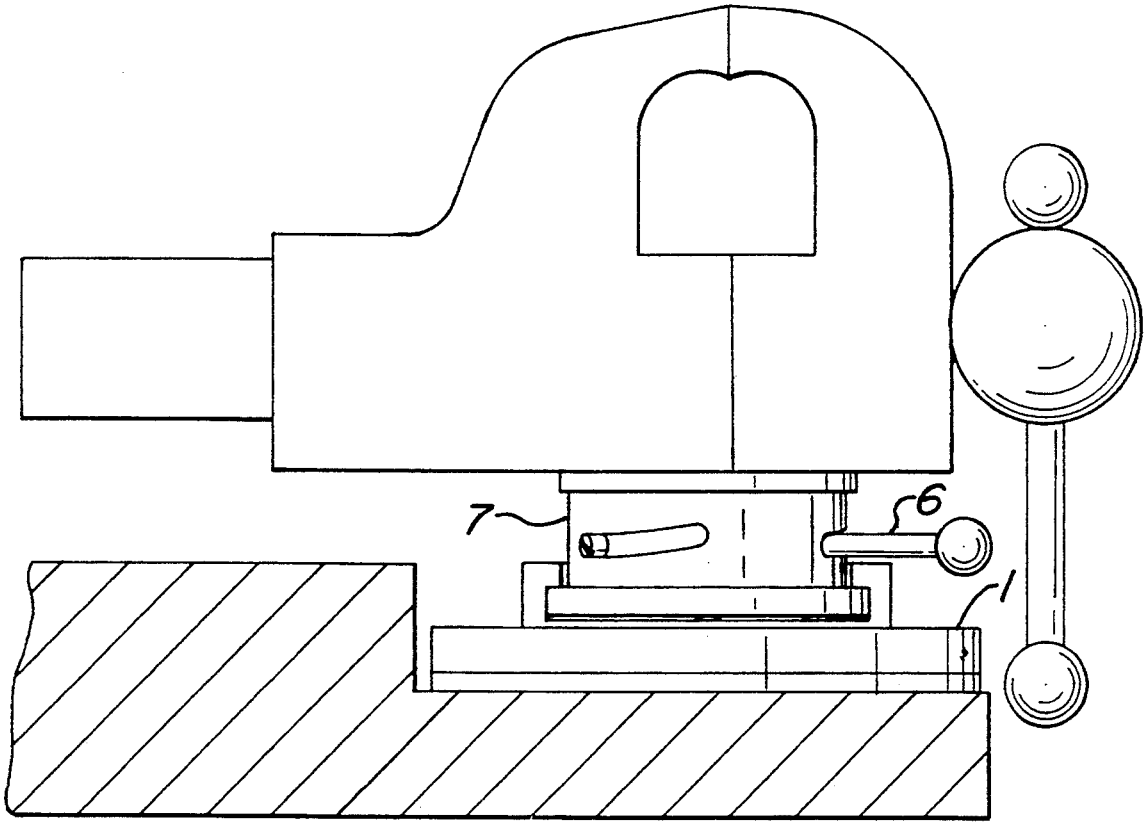
FIG. 1 is a side view of the tool holder with a tool, in this case a vise, mounted in the tool holder.
Figure 4:
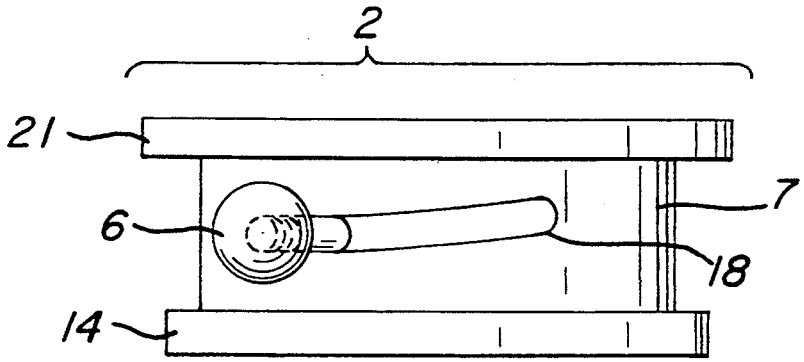
FIG. 4 is a side view showing the mounting assembly.
Figure 2:
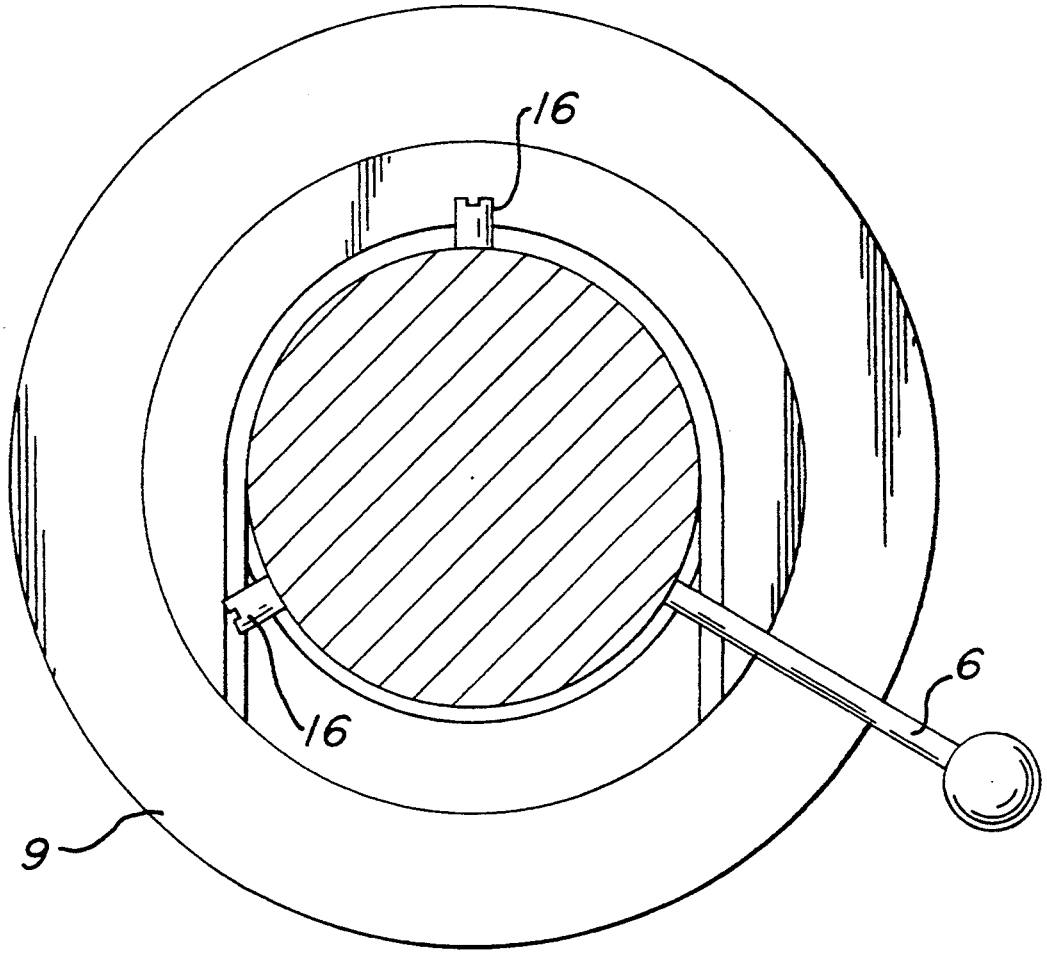
FIG. 2 is a top view of the tool holder showing the base assembly.
Figure 3:
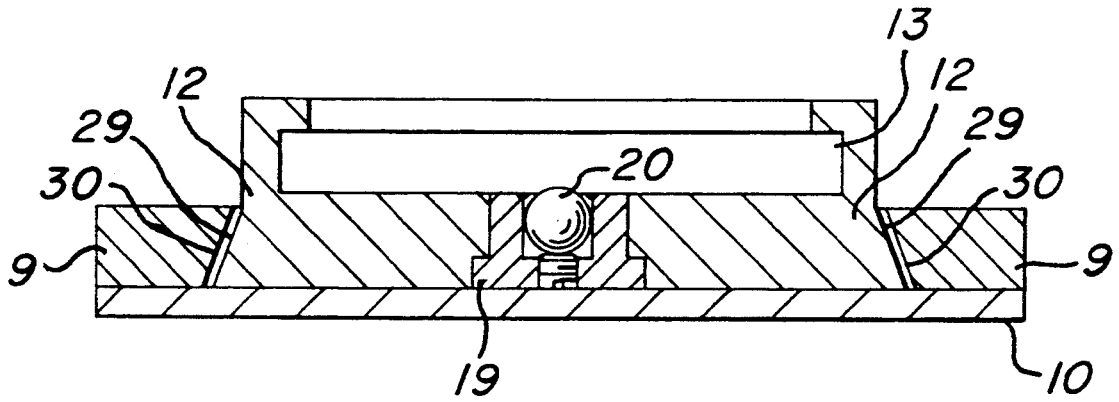
FIG. 3 is a sectional view showing the mounting assembly with tenons inserted into the mortise of the base assembly.
Figure 5:
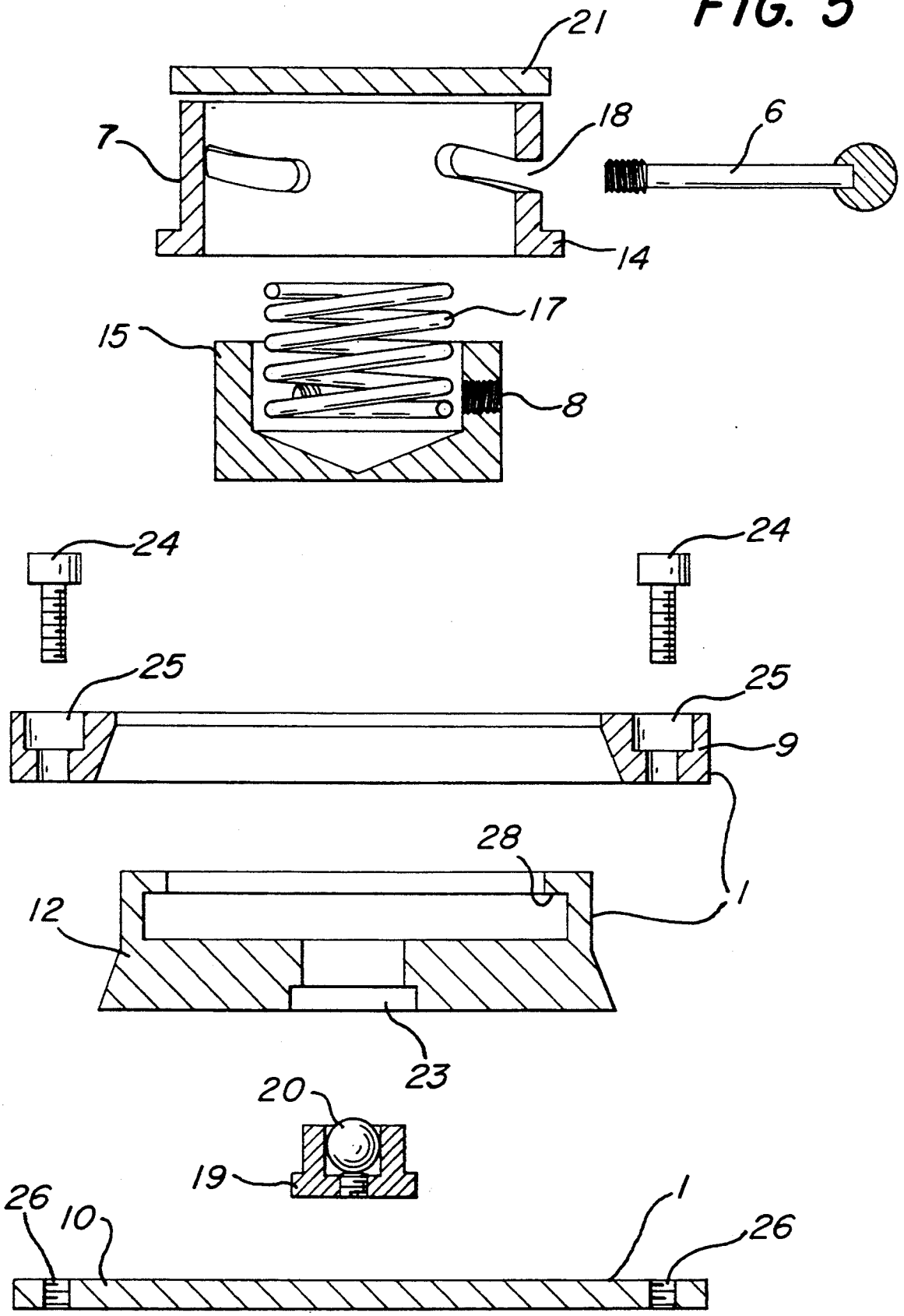
FIG. 5 is an exploded view showing the camming mechanism, swivel plate and base assembly.

Referring to the figures, it can be seen that the mounting assembly 2 comprises a piston 15, a spring 17, two pins 16, a handle 6, and a housing 7, with cam slots 18 , a tenon 14 and a tool mounting surface 21. The two pins 16 are slid through the cam slots 18 and the handle 6 is screwed into the tapped hole 8 in the piston 15. With the mounting assembly 2 stationary, a clockwise pull on the handle 6 rotates the piston 15 and the pins 16, camming the piston slightly downward.

The tool such as a vise, grinder, drill press, and the like, is secured to the tool mounting surface 21. The size of the surface area of the tool mounting surface 21 would be dependent on the tool employed. Various clearance holes, tapped holes, clearance slots or any combination would be used to secure the tool to the tool mounting surface 21.

The mounting assembly 2 with the tenon 14 is inserted into the base assembly 1. The mortise 13 of the swivel plate 12 receives the tenon 14. The swivel plate 12 is secured to the working surface or work bench by the retaining ring 9. The swivel plate 12 and retaining ring 9 have identical mating tapers. There is clearance between the ID of the retaining ring 9 and the secondary OD of the swivel plate 12. A hole 23 through the bottom on the swivel plate 12 holds the bearing retaining 19 which houses the single ball bearing 20.

The retaining ring 9 rests on top of the bottom plate 10 holding the swivel plate 12 and bearing retainer 19 in place permitting full 360° swivelability of the mounting assembly and the tool that is attached to it. Cap screws 24 pass through the counter bored clearance holes 25 in the retaining ring 9 and the clearance holes 26 in the bottom plate 10 and fasten the entire base assembly 1 and the tool to the work bench.

With the tenon 14 of the mounting assembly 2 fully engaged with the mortise 13 of the base assembly 1 a forward pull of the handle 6 rotates the piston 15 and pins 16 only and forces the piston 15 down through the camming action of the slots 18 acting on the pins 16 and the handle 6. The piston 15, through the camming action, exerts pressure on the ball bearing 20. The force is transferred through the bearing 20 to the bottom plate 10. The downward force of the piston 15 through the bearing 20 on to the bottom plate 10 causes the entire mounting assembly 2 and one of its components being the camming mechanism, to rise. This seats the upper surface 21 of the tenon 14 to the top surface 28 of the mortise 13. The result is that the upward force of the swivel plate 12 onto the retaining ring 9 causes sufficient pressure for the conical taper surfaces 29 and 30 to mate and lock.

Without further elaboration, the foregoing will so fully illustrate this invention that others may, by applying current or future knowledge, readily adapt the same for use under the various conditions of service.

I claim:

1. A fastening device for holding an object rigidly in place, at a strategic location, said fastening assembly comprising a base assembly and a tool mount mating with said base assembly, a spring loaded, cam activated piston means comprising camming means locking said base assembly and tool mount assembly, the base assembly further comprising a retaining ring, having a conical internal taper, with said retaining ring being bolted to a bottom plate, a swivel plate having a mating conical taper with the retaining ring conical taper, whereby said tool mount assembly may be disengaged from said base assembly or again engaged wherein a new tool may be secured to the mounting assembly.

2. The fastening device of claim 1 wherein spring means are associated with said piston means.

3. The fastening device of claim 2 wherein said piston means are inserted into said camming means.

4. The fastening device of claim 1 wherein said piston means floats on three points, two of which are pin means.

5. The fastening device of claim 4 wherein the tool mount assembly has handle means which together with said pin means are slid through cam slots in said tool mount assembly.

* * * * *